United States Patent [19]

Schwayder

[11] Patent Number: 4,489,458

[45] Date of Patent: Dec. 25, 1984

[54] STREET SWEEPER DRAG SHOE

[76] Inventor: Warren M. Schwayder, 2335 E. Lincoln, Birmingham, Mich. 48008

[21] Appl. No.: 537,171

[22] Filed: Sep. 29, 1983

[51] Int. Cl.[3] ..... E01H 1/04

[52] U.S. Cl. ..... 15/246; 15/83

[58] Field of Search ..... 15/78, 79, 80, 81, 82, 15/83, 84, 85, 86, 87, 246, 340, 345, 346; 428/908.8; 175/410

[56] References Cited

U.S. PATENT DOCUMENTS

| | | | |
|---|---|---|---|
| 3,997,934 | 12/1976 | Toews | 15/83 |
| 4,037,289 | 7/1977 | Dojan | 15/340 |
| 4,450,601 | 5/1984 | Shwayder | 15/246 |

*Primary Examiner*—Philip R. Coe
*Assistant Examiner*—Arthur D. Dahlberg
*Attorney, Agent, or Firm*—Cullen, Sloman, Cantor, Grauer, Scott and Rutherford

[57] ABSTRACT

A street sweeper drag shoe, formed of a horizontally elongated rubber-like strip, having a bottom ground-engaging edge surface, is provided with vertically arranged wear resisting pins embedded within the strip, with the lower ends of the pins exposed at, and flush with, the edge surface. Each pin is formed of a thin wall steel tube filled with a closely packed matrix of particles of hard metal carbide surrounded by a soft, heat conductive, copper-like binder. The tube outer wall surface is provided with surface irregularities, such as knurls or threads. The pins are each forcibly driven endwise into smaller cross-sectional size holes that are pre-formed in the strip and that open at the strip bottom surface. Thus, the strip, rubber-like material resiliently yields as the pin is inserted, and then resiliently grips and interlocks with the tube outer wall surface.

9 Claims, 9 Drawing Figures

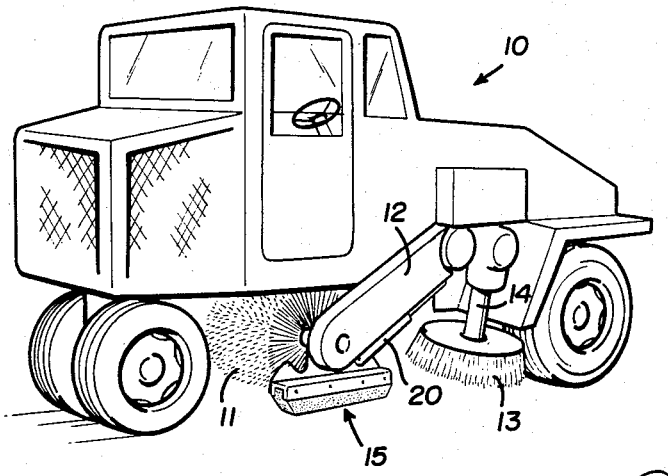
FIG. 1
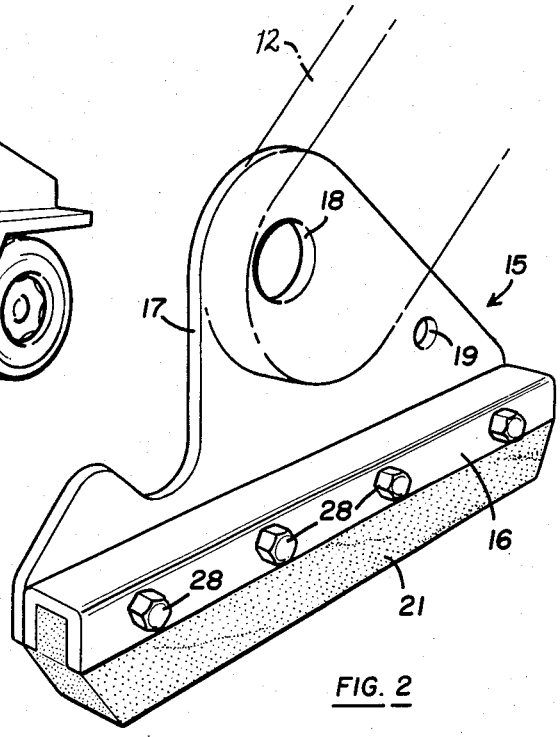
FIG. 2
FIG. 3
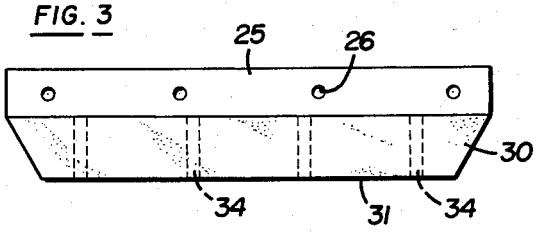
FIG. 4
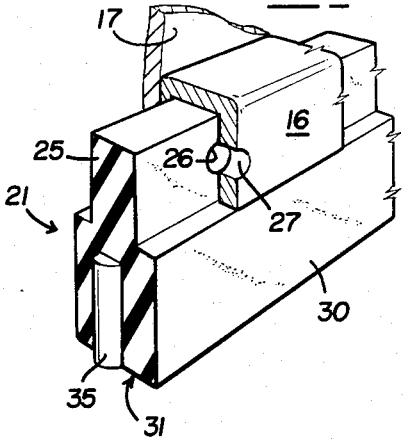
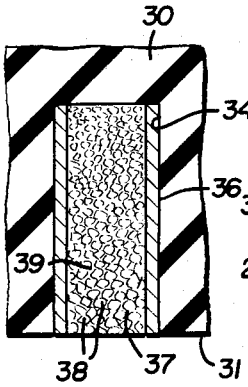
FIG. 5
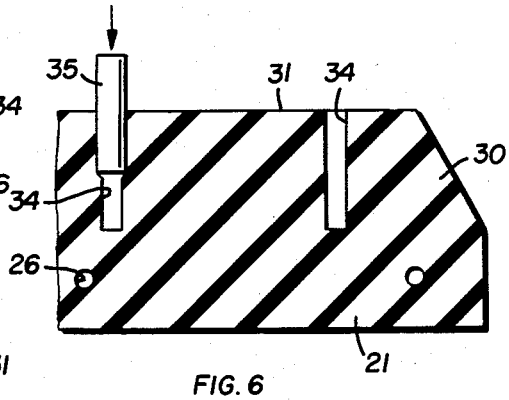
FIG. 6
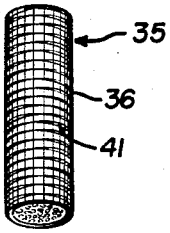
FIG. 7
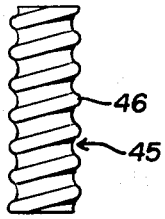
FIG. 8
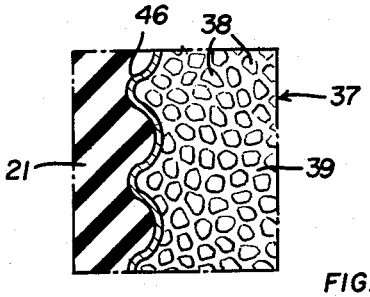
FIG. 9

STREET SWEEPER DRAG SHOE

BACKGROUND OF INVENTION

This invention relates to an improved drag shoe for use on street sweepers. Such sweepers generally comprise a tractor-like vehicle beneath which is mounted a horizontally axised, rotary sweeper brush. As the brush rotates while the vehicle is driven along a street, debris is swept from the ground into a hopper on the vehicle, from which the debris is periodically unloaded. Conventionally, such sweepers also include vertically axised rotary gutter brooms or brushes to sweep debris, located adjacent the curb of a street, into the path of the horizontally axised brush.

As the horizontally axised brush rotates, debris near the outer edges of the brush tend to move sidewise of the vehicle rather than be swept up into the hopper. To prevent this generally sidewise drift of debris from the brush edges, it is conventional to mount a drag shoe at each of the opposite ends of the brush. These shoes function as walls or barriers, to contain and to guide the debris against sidewise movement relative to the brush.

Conventional drag shoes include a ground-engaging edge portion which is shaped like an elongated ski and moves longitudinally or endwise along the ground. An upwardly extending plate secured to the shoe and to the vehicle, cooperates with the shoe to form a barrier for debris.

One conventional form of drag shoe is made of an elongated strip of rubber-like material which is approximately rectangular in cross-section and has one of its narrow edges forming a bottom, ground-engaging surface. The upper edge portion is secured within a channel which, in turn, in secured to the support plate which connects the drag shoe to the vehicle.

Naturally, the lower ground-engaging edge of a drag shoe tends to wear away rapidly due to the friction between the ground-engaging surface and the ground. Thus, various attempts have been made to reduce the wear, but nevertheless, such shoes have relatively short lives. This is particularly true where the shoes are made of the resilient, softer rubber-like materials.

The invention herein is concerned with an improvement to sweeper drag shoes which materially increases the life of each shoe with a relatively nominal increase in cost.

SUMMARY OF INVENTION

This invention contemplates embedding within the lower edge of an elongated skid shoe pegs or pins made of metal tubes filled with a matrix formed of closely packed irregularly shaped particles of hard, metal carbides embedded within a binder of soft, heat conductive metal such as copper. These pins, which are arranged generally perpendicular to the ground-engaging edge of the shoe, have their bottom ends exposed at and approximately flush with the shoe bottom edge.

The pins are mounted within the shoes by forcibly driving them into pre-formed holes whose cross-sectional dimensions are considerably smaller than that of the pins. Preferably the exterior surfaces of the tubes that form the pins are provided with surface irregularities, such as knurling or threading so that there is a mechanical and frictional interlock between the resilient rubber-like material forming the shoe due to the elastic displacement of the material during the forcible entry of the pins within their receiving sockets or holes and the resilient recovery of the material defining the hole. Moreover, the resilient material around the hole exerts a uniform, radially inwardly directed and circumferential compression upon each pin which tends to materially strengthen and protect the pins against damage because of impacts, frictional drag and the like.

Although it is contemplated to use a minimal number of such pins, spaced widely apart, along the length of the drag shoe, it has been found that a few of these pins very substantially increase the life of the shoes while not affecting the shoe function. Further, it has been found that the pin matrix seems to provide for a reduction of friction between the lower edge of the shoe and the ground. Although it would appear that the irregular, hard carbide particles would tend to provide additional frictional drag against the ground, it has been found that the matrix, as a whole, actually appears to reduce friction, possibly because of the embedding of the hard carbide particles within the soft, somewhat yieldable or resilient, copper or copper bearing binder. The copper material dissipates heat caused by friction which appears to have a positive effect in minimizing wear and damage to the ground-engaging edge of the shoe. Thus, there has been a surprising increase in wear resistance and reduction of friction.

A major object of this invention is to provide a mean for substantially increasing the life of the drag shoes, but at minimal expense and labor. The pins of this application are inserted within the drag shoes merely by manually drilling holes, spaced considerable distances apart, as for example one foot apart on a shoe of several feet in length, and then hammering a pin into each hole. The amount of time required is minimal and no skilled labor is needed. Consequently, for the minimal expense of the cost of the pins and the small amount of labor, the shoe life is substantially increased which likewise, means that the down-time of the sweeper for shoe repair and maintenance is materially reduced.

These and other objects and advantages of this invention will become apparent upon reading the following description, of which the attached drawings form a part.

DESCRIPTION OF DRAWINGS

FIG. 1 is a perspective, schematic view, of a typical street sweeper vehicle with a sweeper drag shoe positioned at the side of the vehicle, next to one end of the horizontally axised rotatable sweeper brush.

FIG. 2 is a perspective view of a typical drag shoe assembly.

FIG. 3 is an elevational view, to a reduced scale, of the sweeper drag shoe, per se.

FIG. 4 is a fragmentary, perspective, cross-sectional view of a portion of the drag shoe and support structure.

FIG. 5 is an enlarged, fragmentary, cross-sectional view of a pin mounted within the drag shoe.

FIG. 6 is a cross-sectional, fragmentary view, showing the insertion of a pin within a pre-formed hole in the shoe.

FIG. 7 shows a pin with knurling forming surface irregularities.

FIG. 8 shows an alternative form of pin with threads formed upon its tube outer wall.

FIG. 9 is an enlarged, cross-sectional, fragmentary view of a portion of the threaded pin of FIG. 8 engaged within the hole formed in a drag shoe.

DETAILED DESCRIPTION

FIG. 1 schematically illustrates a conventional street sweeper vehicle 10 which basically is a driver operated tractor. The vehicle includes an engine so that is self-propelled, and rolls upon conventional wheels. The construction of the vehicle forms no part of this invention and therefore is referred to here only generally and schematically.

The vehicle includes a horizontally axised rotary sweeper brush 11 which is mounted beneath the vehicle by a link-type mechanism 12 which raises and lower the brush into ground-engaging contact. In addition, such vehicles conventionally include rotary, generally vertically axised, gutter brooms or brushes 13 mounted upon the lower end of a rotating mechanism 14.

In operation of the vehicle as it is driven down a street, first, the gutter broom sweeps debris adjacent the curbs, into the path of the horizontally axised sweeper brush. The sweeper brush, in turn, sweeps debrris from the street into a hopper located at the front of the vehicle. Periodically, the hopper is emptied.

Relevant to this invention, such vehicles include a drag shoe assembly 15 located on each of the opposite ends of the sweeper brush 11. The assembly is formed of a metal channel 16 secured to a support or sideplate 17 which is provided with an opening 18 at its upper end for securement to the same linkage system which raises and lowers the sweeper brush. The plate may also have another hole 19 for securement to a separate linkage 20 which adjusts the angle of the drag shoe relative to the ground.

A blade or strip 21 forms the actual drag shoe. This strip is made of a rubber-like, i.e., an elastomeric, material. The material out of which the shoe is made varies, depending upon the desired hardness, resiliency, size and shape and the commercial availability and price of the material. Thus, commercially there are various shoe materials used. However, in general, these materials are rubber-like, relatively stiff and self-sustaining in shape, will resiliently yield under pressure and will resiliently recover.

The shoe forming strip is generally formed with a narrow, elongated upper edge mounting portion 25, which fits within the channel 16. For securement to the channel, holes 26 are formed in the strip and aligned with holes 27 formed in the channel so that bolts or the like mechanical fasteners 28 may be inserted through the holes for fastening the strip to the channel.

The lower, lengthwise portion of the strip, which is preferably made somewhat wider than the upper portion (see FIG. 4) forms the lower drag section 30 whose bottom 31 provides a ground-engaging edge surface that rides along the street in contact therewith.

The construction disclosed above, to this point, is a commercially used and known device. The improvement relates to the pins and the manner of mounting and using such pins.

Holes 34 are formed in the bottom edge 31 of the strip to receive drag shoe pins or pegs 35. These pins are made of tubes 36 which are filled with a matrix 37 of closely packed particles 38 formed of hard metal carbides, embedded with a soft, heat conductive binder 39.

Preferably, the tubes are formed of thin wall mild or low carbon steel. By way of example, a tube may be approximately ½ inch in outer diameter and about 2 inches in length for use with a drag shoe skid that may be on the order of two or more feet in length and roughly 4 inches in height and about 1-¼ inches in width. The actual sizes can be varied considerably depending upon the particular size and shape drag shoe required for a specific vehicle. In this instance, the steel tube has a thin wall, such as on the order of 0.049 inches thick, which is roughly 3/64ths of an inch in wall thickness.

The matrix, as mentioned, is formed of a hard metal carbide, as for example, cemented tungsten carbide with a 6–13% cobalt content. However, other carbides can be used likewise, such as titanium, tantalum, cast tungsten carbide $W_2C$, and the like. While the carbide particles may vary considerably in size, and are irregular in size and shape, it has been found that a 12/35 mesh size is in the approximate range of providing good performance. However, the mesh size is not critical and can be varied considerably, such as between about −6 to +40 mesh.

The binder is preferably made of commercially pure copper for good heat dissipation results. However, other copper containing binders may be used, such as bronze of the typical brazing compounds or muntz metal and the like. These copper or copper containing metals are relatively soft, somewhat resilient and dissipate heat well. Other binders, that is, non-cuprous materials can be used, but these have been found to be most satisfactory for this purpose. The wall is bonded together with the matrix due to the binder.

Preferably, the outer wall surface of the pin tubes are formed with surface irregularities, such as relatively deep knurling 41 (see FIG. 7). Alternatively, a threaded pin 45 may be formed with threads 46 that are roll formed in the conventional manner. Thread-like or barb-like corrugations may also be used in the same manner as the threads shown.

In operation, the drag shoe is first, turned upside down, as shown in FIG. 6, and holes 34 are drilled in its bottom surface. These holes may be widely spaced apart since only a few pins are needed for the strip. The holes, could be molded or otherwise pre-formed in the strip, but drilling appears to be the swiftest and most effective way of providing the needed sockets for the pins.

The holes are of a cross-sectional size which is considerably smaller than the cross-sectional size of the pins which they receive. For example, a drill hole of about 7/16ths of an inch is used to receive a ½ inch diameter tube.

Next, the pins are forcibly inserted into the holes, usually by pounding them in with a hammer, as indicated by the arrow in FIG. 6. The forcible insertion causes a resilient displacement of the material surrounding or defining the hole. However, when the pin is in place, with its exposed end approximately flush with the ground-engaging surface of the shoe, the rubber-like material resiliently recovers and mechanically interlocks with the surface irregularities of the tube, as well as frictionally locks to the tube wall. FIG. 9 shows the mechanical and frictional interlock between the rolled threads of the tube wall and the adjacent rubber-like material of the shoe.

The resilient shoe material also tends to compress the pins radially inwardly and circumferentially so as to exert a substantial compressive load thereon. It has been found that this compression force tends to keep the particles and the binder under sufficient compression to avoid craking or breaking due to road impacts and drag upon the road. Moreover, the resiliency of the shoe material holding the pin in place, permits some resilient displacement of the pin and hence, serves to absorb impacts. The soft, somewhat resilient binder of the matrix permits some resilient displacement of the hard particles. Consequently, the combined effect is to protect the pin and the matrix against premature breakage or disintegration, to maintain a solid or integral appearing matrix end which rubs against the ground and, finally, to protect the ground-engaging surface of the shoe, resulting in an unusually, unexpected high increase in wear life.

Having fully described an operative embodiment of this invention, I now claim:

1. In a drag shoe for mounting upon a street sweeper vehicle so as to contact the ground for guiding debris during sweeping, with the drag shoe formed of a horizontally elongated, roughly rectangular cross-section shaped strip of an elastomeric material which has a relatively narrow, bottom, ground-engaging edge surface extending substantially its full length for moving upon the ground in a longitudinal direction relative to the strip length, and having an upper edge portion adapted to be secured to a means for fastening the strip to the vehicle, the improvement comprising:

a number of pins embedded within the strip at widely spaced apart distances in the strip longitudinal direction, with the pins extending from the strip bottom engaging edge surface upwardly towards the strip upper edge, and with the lower end of each pin being generally co-planar with and exposed at the strip bottom surface;

each pin comprising a thin wall steel tube of greater length than diameter;

and the tubes being filled with a matrix of irregularly shaped, hard carbide particles closely packed together and embedded within a binder of cuprous brazing-type metal;

with the exposed lower ends of the tubes being open so that the portion of the matrix which is exposed at said tube lower ends contact the ground simultaneously with the edge of the tube lower ends and the strip bottom ground-engaging edge suface.

2. In a drag shoe as defined in claim 1, and each of said pins being positioned within a pre-formed hole provided in the strip, with the cross-sectional size of the hole being considerably less than that of the pin, so that the pin must be forcibly inserted within the hole wherein the strip rubber-like material defining the hole resiliently yields during insertion of the pin and correspondingly resiliently grips against and locks to the pin tube outer wall for holding the pin within the hole.

3. In a drag shoe as defined in claim 2, and wherein the outer wall surface of the tube is provided with surface irregularities for receiving and interlocking with the strip rubber-like material.

4. In a drag shoe as defined in claim 3, and with thread-like configurations being formed in the outer wall of the tube to provide the wall surface irregularities for resiliently interlocking with the rubber-like material defining the hole within which the pin is inserted.

5. In a drag shoe as defined in claim 3, and with knurl-like configurations being formed upon the outer wall of the tube to provide the wall surface irregularities for resiliently, mechanically interlocking with the rubber-like material defining the hole within which the pin is inserted.

6. In a drag shoe as defined in claim 2, with said binder being formed of substantially pure, that is, industrially pure grade copper.

7. A method of substantially increasing the effective life of a street sweeper drag shoe of the type formed of a horizontally elongated, roughly rectangular cross-section, rubber-like strip having a narrow bottom edge surface arranged for contacting and scraping along the ground in a generally longitudinal direction relative to the length of the strip, comprising:

forming pins by filling elongated, thin wall, rigid metal tubes with a matrix of closely packed particles of hard metal carbides surrounded and imbedded within a soft, heat conductive metal, such as copper and bronze and the like;

forming a number of vertically elongated holes in the strip with the holes opening at the strip bottom edge surface;

inserting pins into each of the holes, the pins being of greater cross-sectional dimension than the cross-sectional dimensions of the holes so as to cause the rubber-like material to resiliently yield during the pin insertion, but to resiliently recover and grip and interlock with the rubber-like material defining the holes, with the lower end of each tube and the matrix at the tube lower end being exposed and flush with the strip bottom surface so that the lower edge defining portion of the tube, and the matrix exposed at said lower edge, and also, the strip bottom surface will simultaneously engage the ground.

8. A method as defined in claim 7, and including forming surface irregularities, such as knurling, threads, and corrugations in the outside wall surfaces of the tubes for mechanically interlocking the pins within the rubber-like material defining the holes.

9. Street sweeper drag shoe wear pins for forcible insertion into vertically elongated holes, which are cross-sectionally undersized relative to the pin-cross-sectional dimensions, formed in the bottom, ground-engaging surface of horizontally elongated, rubber-like drag shoe strips, said pins each comprising:

a thin wall, steel tube having an open lower end, a filler matrix formed of closely packed, hard metal, cemented carbide particles embedded within a soft, heat conductive, metal binder made of a cuperous material, with the matrix being exposed at the open, lower end of the tube;

with the outer wall surface of said tube having irregularities formed thereon, such as knurling, threads and corrugations;

whereby each of said pins may be forcibly driven into a hole in the drag shoe strip for resiliently displacing the material defining and surrounding the hole until the lower end of the tube is about flush with the ground-engaging surface of the strip, and the rubber-like material will frictionally and mechanically interlock with the tube outer wall surface so that the tube lower edge, the matrix and the ground-engaging surface all rub along the ground simultaneously during operation of a sweeper upon which the drag shoe is mounted, with the pins materially reducing shoe wear.

* * * * *